US009366070B2

(12) United States Patent
Baczuk

(10) Patent No.: US 9,366,070 B2
(45) Date of Patent: Jun. 14, 2016

(54) ACTIVE WATER MANAGEMENT FOR FENESTRATION ASSEMBLY

(71) Applicant: Milgard Manufacturing Incorporated, Taylor, MI (US)

(72) Inventor: Eric A. Baczuk, Puyallup, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 0 days.

(21) Appl. No.: 14/280,853

(22) Filed: May 19, 2014

(65) Prior Publication Data

US 2015/0330139 A1 Nov. 19, 2015

(51) Int. Cl.

| | |
|---|---|
| ***E06B 7/14*** | (2006.01) |
| ***E06B 1/70*** | (2006.01) |
| ***F17D 1/14*** | (2006.01) |

(52) U.S. Cl.

CPC ... *E06B 1/70* (2013.01); *E06B 7/14* (2013.01); *F17D 1/14* (2013.01); *Y10T 137/0318* (2015.04); *Y10T 137/85978* (2015.04)

(58) Field of Classification Search

CPC ..... E06B 7/14; E06B 1/70; F17D 1/14; Y10T 137/6969; Y10T 137/698

USPC ..... 49/404, 408, 504; 52/207, 209, 302.1, 52/173.1

See application file for complete search history.

(56) References Cited

U.S. PATENT DOCUMENTS

| | | | | |
|---|---|---|---|---|
| 3,900,044 | A * | 8/1975 | Seidman | 137/360 |
| 5,468,185 | A | 11/1995 | Truitt | |
| 6,170,207 | B1 | 1/2001 | Saindon | |
| 6,389,834 | B1 | 5/2002 | Leclear et al. | |
| 7,344,124 | B2 | 3/2008 | Hayden | |
| 7,574,829 | B1 * | 8/2009 | Prager | 49/408 |
| 8,104,502 | B2 | 1/2012 | Nakata et al. | |
| 8,117,789 | B2 | 2/2012 | Teodorovich | |
| 8,458,968 | B2 * | 6/2013 | Shoshan | 52/209 |
| 2005/0257433 | A1 * | 11/2005 | Dussault et al. | 52/12 |
| 2007/0175112 | A1 * | 8/2007 | Janesky | 52/169.5 |
| 2007/0251164 | A1 | 11/2007 | Egeresi | |
| 2009/0218264 | A1 * | 9/2009 | Hall et al. | 210/134 |
| 2009/0241442 | A1 * | 10/2009 | MaClean et al. | 52/220.3 |
| 2010/0307057 | A1 * | 12/2010 | Hashimoto et al. | 47/79 |
| 2011/0005602 | A1 * | 1/2011 | Harrington | 137/1 |
| 2011/0162297 | A1 * | 7/2011 | Roelofsen | 52/173.1 |
| 2011/0185657 | A1 * | 8/2011 | Delaquis | 52/236.3 |
| 2011/0283641 | A1 * | 11/2011 | Aubut | 52/302.1 |
| 2012/0060433 | A1 * | 3/2012 | Chandler | 52/169.5 |

(Continued)

FOREIGN PATENT DOCUMENTS

| | | | | |
|---|---|---|---|---|
| GB | 2209787 | A * | 5/1989 | E06B 7/14 |
| GB | 2229479 | A * | 9/1990 | E06B 7/14 |

(Continued)

*Primary Examiner* — Jerry Redman

(74) *Attorney, Agent, or Firm* — Rathe Lindenbaum LLP

(57) ABSTRACT

A water management system for a fenestration assembly including a sash and a frame having a sill with a sash receiving region. A water collection space may be defined within a hollow portion of the sill. An active water management system may include a pump positioned within the frame of the fenestration assembly, a power source, a water sensor positioned within the hollow portion of the sill, a water intake positioned within the hollow portion of the sill, and a water outlet extending out of the fenestration assembly, with the water inlet and the water outlet in fluid communication with the pump.

12 Claims, 8 Drawing Sheets

(56) References Cited

U.S. PATENT DOCUMENTS

| | | | | |
|---|---|---|---|---|
| 2013/0036691 | A1* | 2/2013 | Janesky | 52/302.1 |
| 2014/0123578 | A1* | 5/2014 | Ingber et al. | 52/171.3 |
| 2015/0047713 | A1* | 2/2015 | Acklin | 137/15.01 |

FOREIGN PATENT DOCUMENTS

| | | | | | |
|---|---|---|---|---|---|
| GB | 2230042 | A | * | 10/1990 | E06B 7/14 |
| JP | 06200570 | A | * | 7/1994 | E04B 1/80 |

* cited by examiner

ACTIVE WATER MANAGEMENT FOR FENESTRATION ASSEMBLY

CROSS-REFERENCE TO RELATED PATENT APPLICATIONS

None.

BACKGROUND OF THE INVENTION

It is common is home construction and renovation to install large patio or sliding doors to permit ingress to and egress from a building or other structure while providing a very large visual opening to the outside. Due to the size of these sliding doors and there need to provide easy passage through the door, it may be desirable to have the lower sills of these sliding doors to be as low as possible. Such low sills provide less chance to trip or otherwise impede movement through the sliding door, when the door is open.

However, when the door is closed, it may be desirable to have a more significant sill height as the closed sliding door needs to also prevent water infiltration under the lower edge of the door. Since the lower edge of the sliding door positioned essentially at the floor level, the lower edge of the door will receive relatively less protection from any building overhangs and may be subjected to more rain, or wind-driven rain than a more traditional window. When excessive water enters the lower sill of the sliding from the outside, it is possible for this water to flow over the top of the lower sill and enter the building to which the sliding is attached or penetrate within the wall to which the door may be attached. Similar problems exist within regard to swinging doors as well.

While more traditional windows do not have the step over problem described above with respect to sliding doors, it is not uncommon for water to be trapped with such a window as well. Conventional approaches have incorporated passive weeping arrangements to allow trapped water to be removed from the window by gravity, but these approaches are not always effective and may become less effective over time with accumulated debris or growth. Further, an exceptionally tall sill height is not desirable in traditional windows as such a raised sill can obscure a portion of the view through the window or fenestration opening.

Improvements to conventional sliding doors and windows are desirable to provide for a lower sill height while ensuring that water infiltration over the lower sill in minimized.

SUMMARY OF THE INVENTION

The present disclosure relates generally to water management systems for fenestration units. More specifically, the present disclosure relates to an active water management system for a fenestration assembly including a sash and a frame having a sill with a sash receiving region. A water collection space may be defined within a hollow portion of the sill. The active water management system may include a pump positioned within the frame of the fenestration assembly, a power source, a water sensor positioned within the hollow portion of the sill, a water intake positioned within the hollow portion of the sill, and a water outlet extending out of the fenestration assembly, with the water inlet and the water outlet in fluid communication with the pump.

In another embodiment a water management system comprises a fenestration assembly including a sash having a bottom rail and a frame having a sill with a sash receiving region. The bottom rail includes a water collection space in a hollow portion of the bottom rail. An active water management system includes a pump positioned within the sash of the fenestration assembly, a power source, a water sensor positioned within the hollow portion of the bottom rail, a water intake positioned within the hollow portion of the bottom rail, and a water outlet extending out of the fenestration assembly, with the water inlet and the water outlet in fluid communication with the pump.

In a further embodiment, a method of managing water collecting within a fenestration assembly comprises providing a fenestration assembly including a sash and a frame having a sill with a sash receiving region, and a water collection space in a hollow portion of the sill. The method also includes positioning an active water management system comprising a pump positioned within the frame of the fenestration assembly, a power source, a water sensor positioned within the hollow portion of the sill, a water intake positioned within the hollow portion of the sill, and a water outlet extending out of the fenestration assembly. The water sensor sensing the presence of water within the water collection space. The active water management system energizing the pump to draw water sensed by the water sensor from the water collection space through the water inlet and expel it from the fenestration unit through the water outlet.

BRIEF DESCRIPTION OF THE DRAWINGS

The accompanying drawing figures, which are incorporated in and constitute a part of the description, illustrate several aspects of the present disclosure and together with the description, serve to explain the principles of the present disclosure. A brief description of the figures is as follows.

DETAILED DESCRIPTION

Reference will now be made in detail to exemplary aspects of the present disclosure which are illustrated in the accompanying drawings. Wherever possible, the same reference numbers will be used throughout the drawings to refer to the same or like parts.

Figure 1:
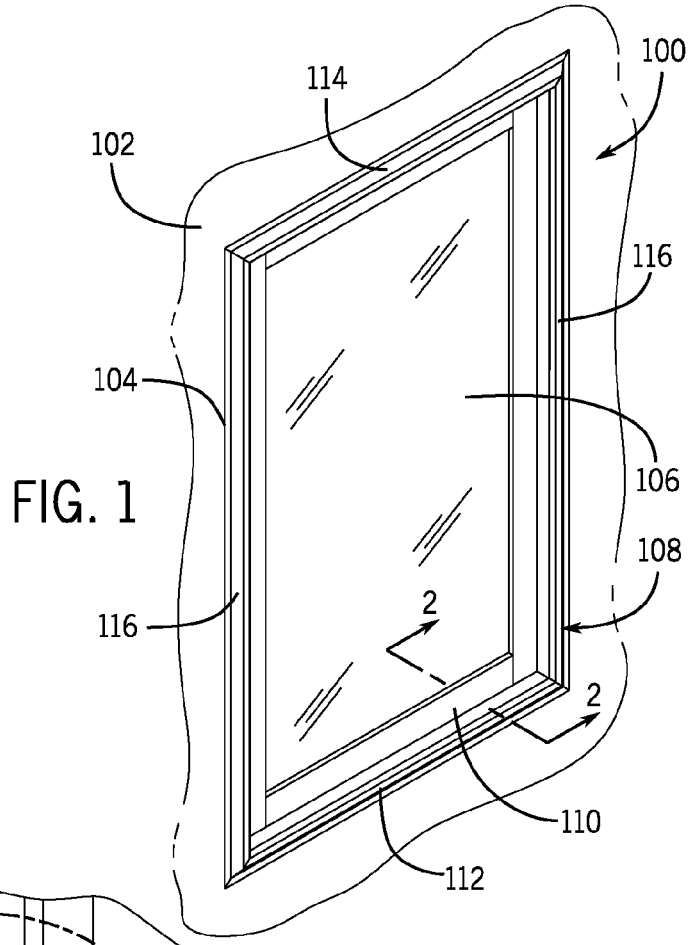
FIG. 1 is a perspective view of a window according to the present disclosure.

Referring to FIG. 1, a window unit or fenestration assembly 100 may be mounted within an opening 104 of a wall 102 of a building. Window unit 100 may include a transparent or opaque pane or sash 106 that is included to allow light to pass through the window as well as a frame assembly 108 that is preferably mounted within opening 104. Window frame 108 may include a header 114, a pair vertical jambs 116 and a sill 112 with a sash receiving region. A rail or lower sash portion 110 may be positioned at a lower edge of sash or pane 106 and may be configured to interface with the sash receiving region of sill 112 so that a preferably weathertight closure can be maintained when window assembly 100 is in a closed position, as shown, while still allowing window unit 100 to be opened to permit light and/or airflow through opening 104 of wall 102.

Since weather conditions outside window unit 100 may result in rain or other water splashing onto a lower portion of window unit 100 as well as possible being propelled into an interface between lower sash portion 110 and sill 112, it is possible that such a lower sill may allow for an undesirable amount of water to enter over lower sill 112 and beneath lower sash portion 110. To prevent this water from entering the building or possibly damaging the structure or materials of wall 102, a water management system may be added during the installation of window unit 100.

Figure 2:
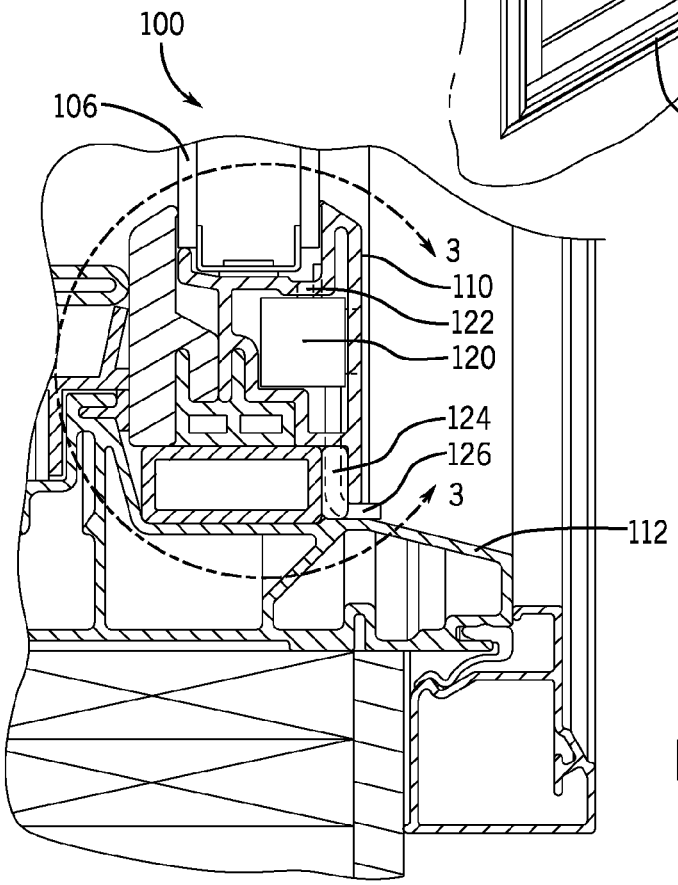
FIG. 2 is a cross-sectional view of a lower portion of the window of FIG. 1, showing a lower sill arrangement with an active water management system for removing water from the lower sill area, with the cross-section taken along line 2-2 in FIG. 1.

Referring now to FIG. 2, a closer view of a lower portion of window unit 100 from FIG. 1 illustrates a water collection space 120 with a water path 122 permitting water that infiltrates adjacent pane 106 to pass into water collection space 120. A water outlet 124 provides a path for water within water collection space 120 to pass from within window unit 100 and exit sill 112 via a water outlet 126. Thus, when and if the desired weathertight closure along a lower portion of window unit 100 fails to exclude all moisture from entering within window unit 100, water collection space 120, in cooperation with water paths 122 and 124 may serve to collect and channel water out of window unit 100.

While passive water removal systems have been used in the past that rely on gravity to urge water from within a fenestration unit, such passive approaches have worked as well as might be desired and more active water management system to expel water according the present disclosure was developed. Such an active water management system may utilize or enhance conventional passive water removal systems, or may be incorporated into new designs and constructions for fenestration assemblies according to the present disclosure.

Figure 3:
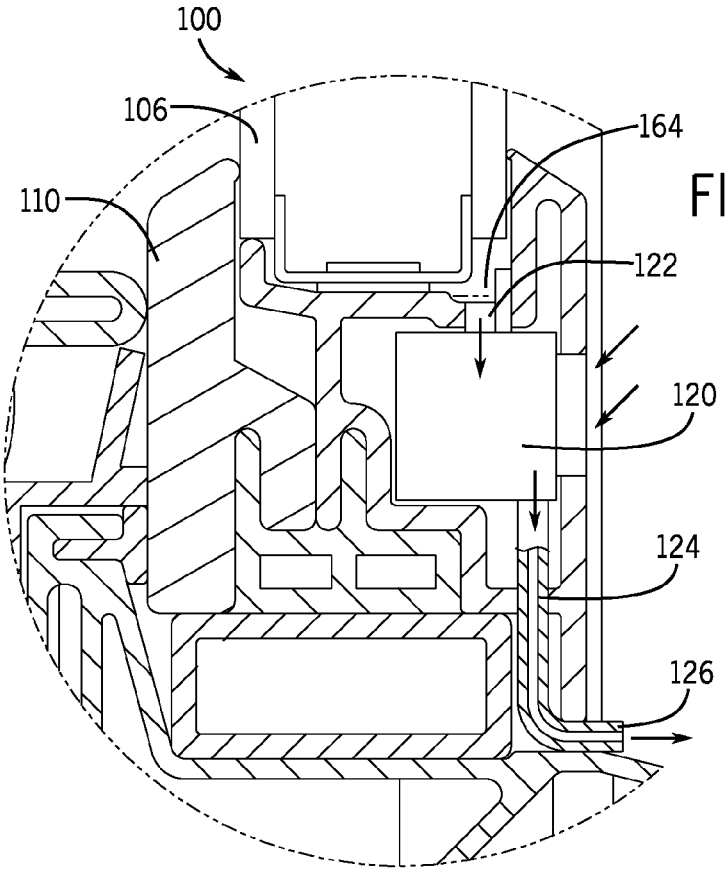
FIG. 3 is a closer cross-sectional view of the window of FIG. 1, enlarging the area marked by circle 3-3 of FIG. 2, showing the active water management system of the window.
Figure 4:
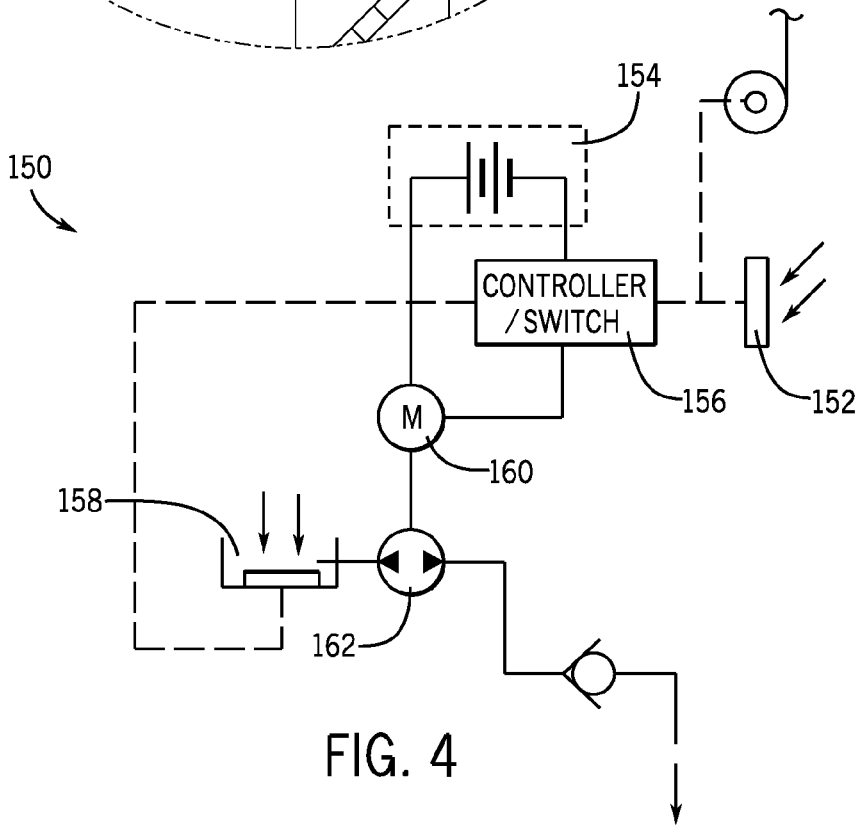
FIG. 4 is a schematic diagram of an embodiment of an active water management system for a window or sliding door according to the present application.
Figure 5:
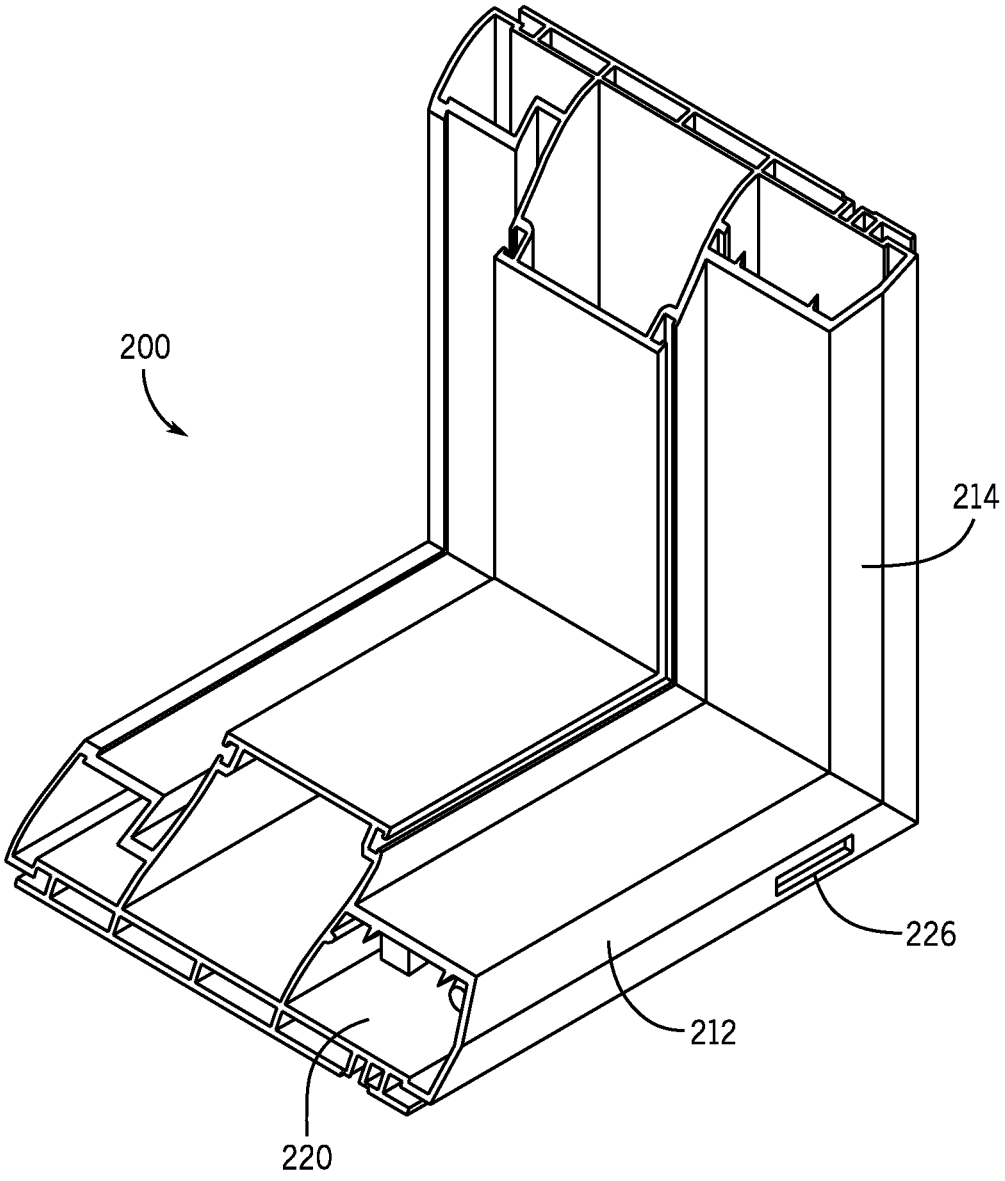
FIG. 5 is a perspective view of a portion of a window frame of a fenestration unit with active water management according to the present disclosure.

FIGS. 3 and 4 illustrate the incorporation of an active water management system 150 incorporated into fenestration assembly 100 of FIG. 1. Active water management system 150 may include a power source such as but not limited to a solar cell 152 that may be positioned on an outer portion of fenestration unit 100 so as to be exposed to a light. Alternatively, active water management system 150 may incorporate a battery 154 or wired power source within the scope of the present disclosure.

Regardless of the power source or combination of power sources used, power source 152 may be electrically connected via circuitry to a controller/switch 156 and a water sensor 158 which may be positioned within water collection space 120. In operation, when water sensor 158 comes into contact with a sufficient quantity of water, such as within water collection space 120 when water has entered within fenestration unit 100, an electrical circuit may be completed between power source 152 and a motor 160. When energized, motor 160 may be coupled to or otherwise drive a pump 162 to expel water from water collection space 120 through water path 124 and exiting from fenestration unit 100 via water outlet 126.

Further, fenestration unit 100 may include a smaller initial water collection space 164 more closely adjacent to pane 106 to permit any small amount of water infiltrating into the fenestration unit to be quickly gathered and directed toward water collection space 120 for accumulation. This splitting of an initial collection space from an accumulation space may assist in moving infiltrating water quickly away from areas where water damage might occur most rapidly. A passive water management system may be combined with the active water management system of the present application to allow slowly accumulating water to weep away from the fenestration unit via force of gravity while providing a rapid evacuation approach when rapidly infiltrating water might overwhelm the ability of such a passive system to expel the entering water.

As shown in FIGS. 2 and 3, water may passively exit fenestration unit 100 through paths 122 and 124, and water collection space 120 and upper water collection space 164 when such infiltrating water is in relatively low volumes. When such infiltrating water is coming in at a higher volume than the passive system may be able to handle, rising water within water collection space 120 may rise high enough to trigger water sensor 158 to energize motor 160 to initiate active water management to remove the excess water.

Referring now to FIGS. 5 to 9, an alternative embodiment of a frame portion 200 of a fenestration unit according to the present disclosure is shown with an active water management system 250 embedded within a sill 212 and a jamb 214 of a window frame 208. A water collection space 220 may be defined within sill 212 with a water outlet 226 exiting sill 212.

Figure 6:
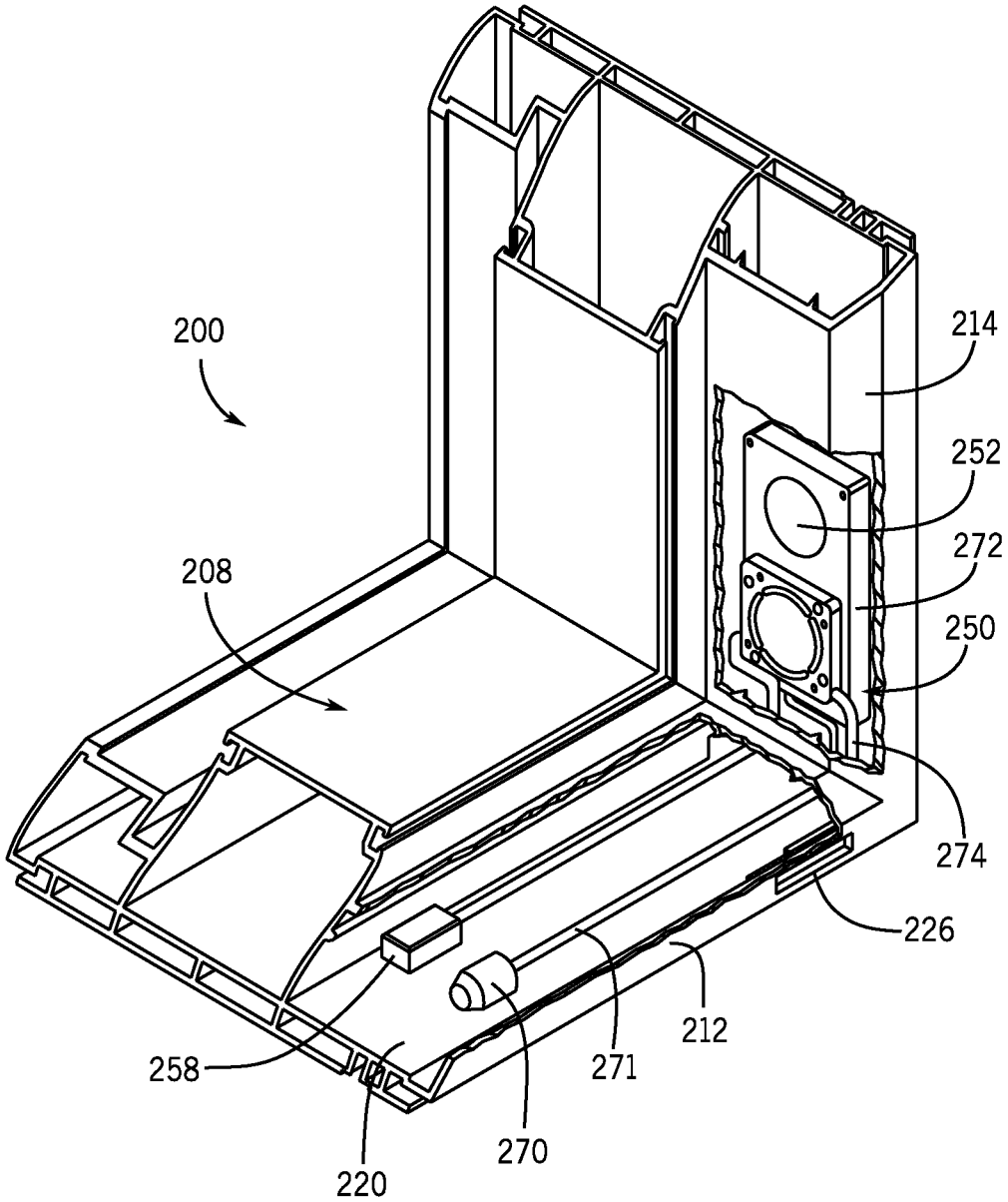
FIG. 6 is a perspective view of the window frame portion of FIG. 5 with portions of the frame removed to illustrate possible placement of elements of the active water management system within the window frame.
Figure 7:
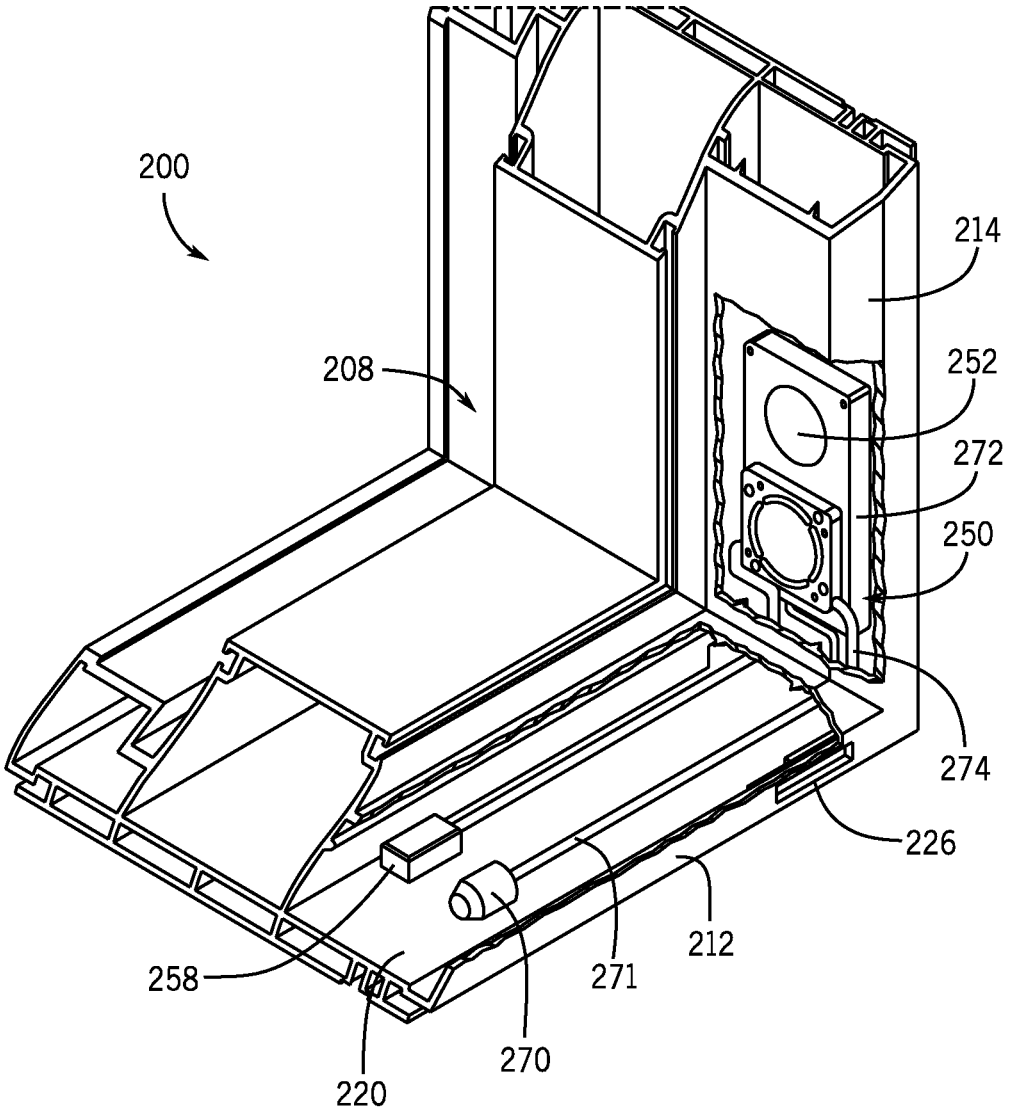
FIG. 7 is a second perspective view of the window frame portion of FIG. 5.

FIG. 6 illustrates frame portion 200 with portions of the sill and jamb removed to show the placement of elements of water management system 250 within the window frame. A water inlet 270 with a square foam filter and a water sensor 258 may be positioned within water collection space 220 and linked in either electrical communication (for water sensor 258) or in fluid communication (for water inlet 270) to a motor-pump assembly 272. Motor-pump assembly 272 may be preferably positioned entirely within window frame 208. Motor-pump assembly 272 may include an integral or replaceable power source 252, such as but not limited to a battery or a solar cell.

As described above, water outlet 226 may be positioned to allow passive water communication from water collection space 220 out of sill 212. Water outlet 226 may also be in fluid communication with a water outlet tube 274 from motor-pump assembly 272.

When sufficient water collects within water collection space 220, water sensor 258 may operate to energize motor-pump assembly 272. Once energized, motor-pump assembly 272 may draw water from within water collection space 220 into water inlet 270 and through a water inlet tube 271 providing fluid communication between water inlet 270 and motor-pump assembly 272. Water may be so drawn from with water collection space 220 into motor-pump assembly 272 and then directed through water outlet tube 274 to exit sill 212 through water outlet 226. When a water level within water collection space has been drawn down sufficiently by operation of active water management system 250, the motor-pump assembly may be de-energized and active water management halted.

Figure 8:
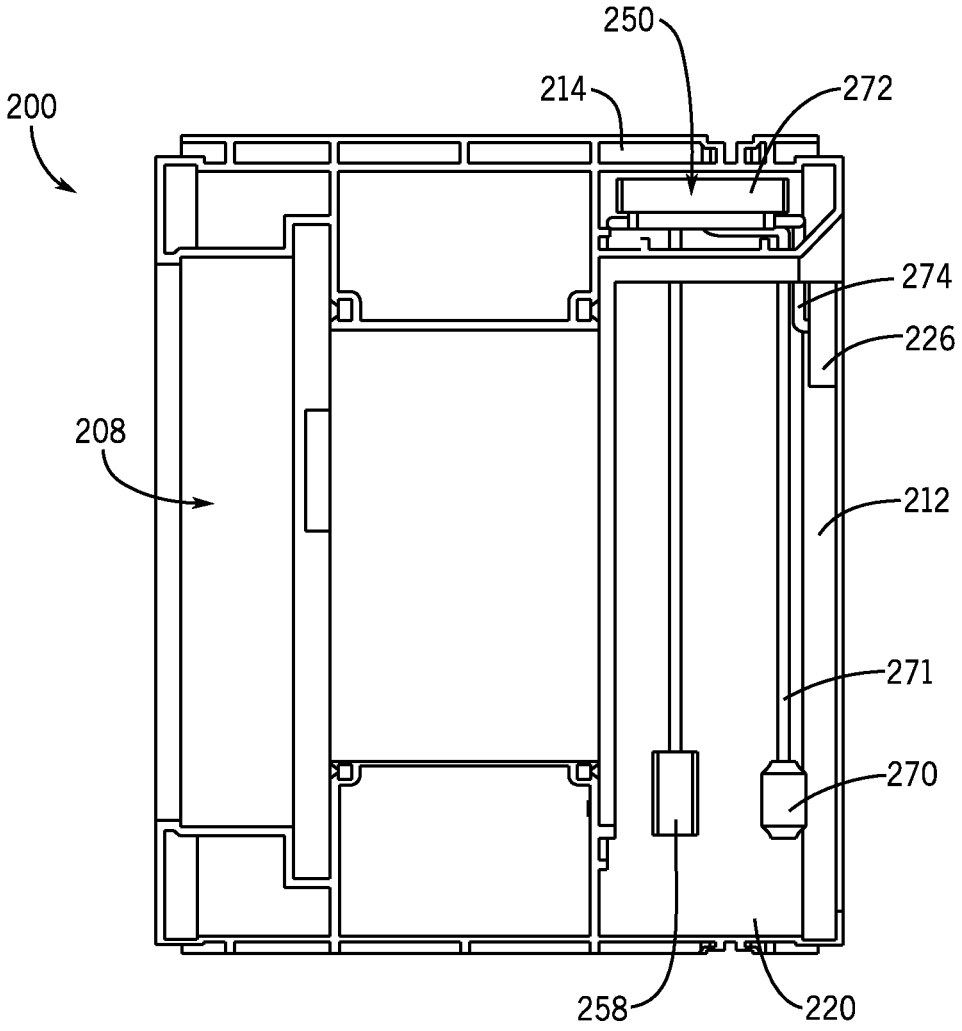
FIG. 8 is a top view of the window frame portion of FIG. 5.

As can be seen in FIG. 8, motor-pump assembly 272 may be located entirely within jamb 214 and included as part of fenestration unit 200 so that when fenestration unit 200 is installed, no separate operation or function may be required to install active water management system 250. Other elements of system 250 may be further entirely enclosed with frame 208 of fenestration unit 200 to ensure that on-site installation of windows may proceed without additional wiring or electrical work being necessary for the operation of the active water management system.

Alternatively, active water management system 250 may be provided as a retrofit options that can be mounted either internally or externally of an already installed window. It is not intended to limit the present application to active water management systems that are integral to or incorporated within the frame of a fenestration unit.

Figure 9:
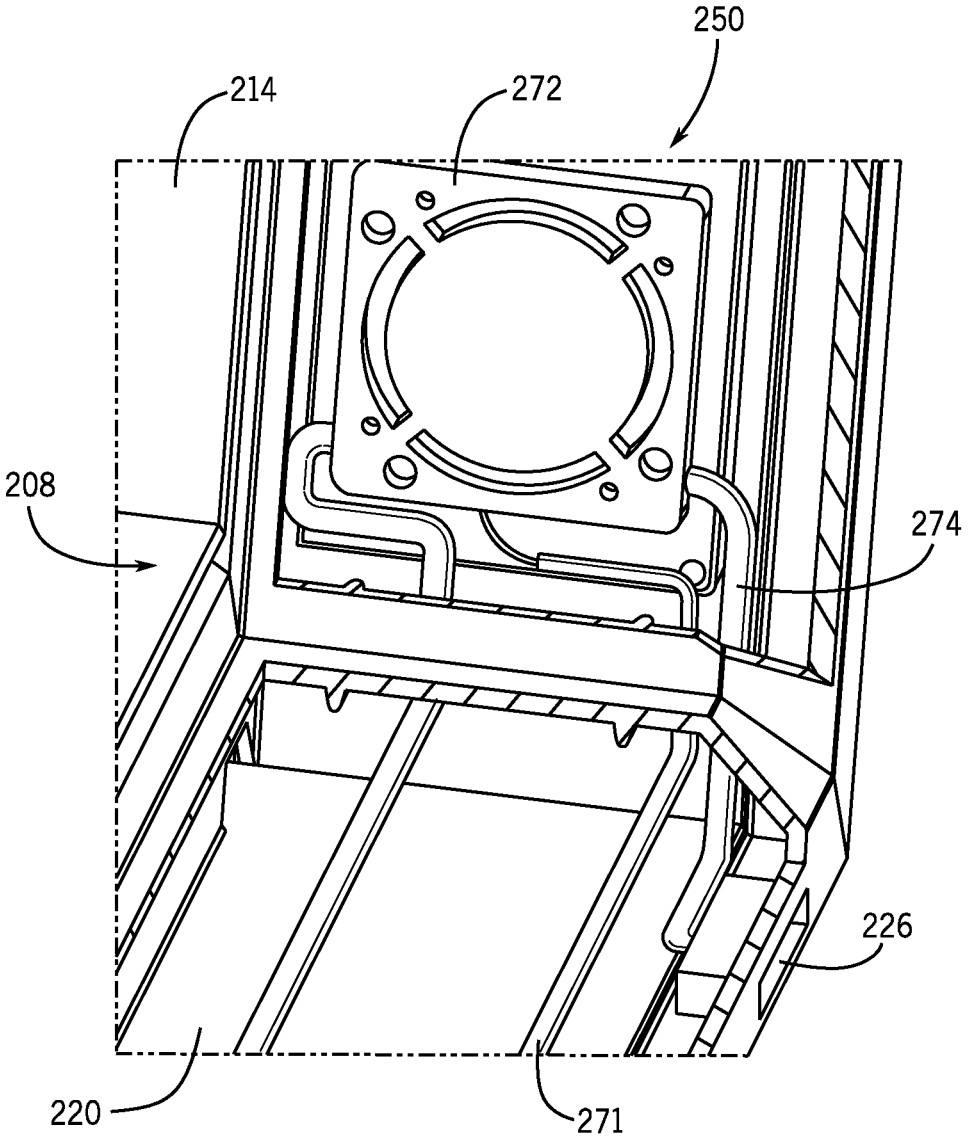
FIG. 9 is a perspective view of a motor-pump assembly of the active water management system of FIG. 5.

FIG. 9 illustrates a closer view of elements of active water management system 250 as they may be positioned within frame 208 of fenestration unit 200. This and the illustrations above of the various options for installing or positioning an active water management system within or adjacent to a fenestration unit according to the present disclosure are presented as illustrative examples of how such an active system may be incorporated with a fenestration unit. It is not intended that these illustrations be considered exhaustive or limiting in the nature and approach to the possible inclusion of the same or similar elements as part of a window or door unit. Nor should these examples be considered exhaustive as to the nature of the installation into which the active water management system of the present application might be incorporated.

Figure 10:
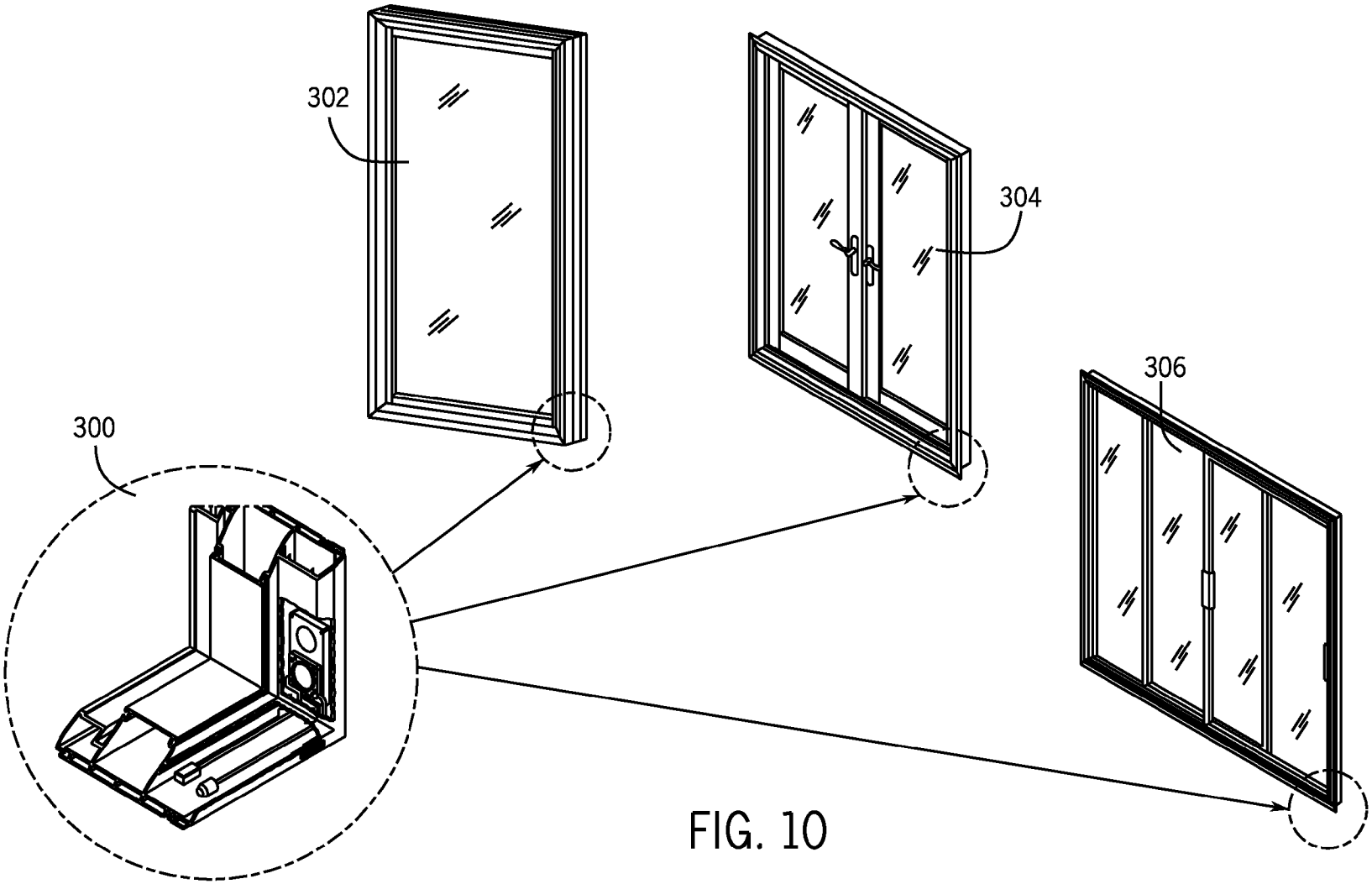
FIG. 10 is a diagrammatic view of an active water management system according to the present disclosure illustrating various types of fenestration units into which the system may be incorporated.

FIG. 10 illustrates how an active water management system 300 according to the present disclosure might be incorporated within a fenestration unit such as but not limited to casement window 302, a swinging door 304, or a sliding door 306. The active water management system of the present disclosure may further be incorporated into more traditionally designed vertical sliding sash windows, or other types and styles of windows beyond what is directly illustrated herein.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A system comprising:

a fenestration assembly including a sash and a frame having a sill with a sash receiving region;

a water collection space in a hollow portion of the sill;

an active water management system comprising a pump positioned within the frame of the fenestration assembly, a power source operatively connected to the pump, a water sensor positioned within the hollow portion of the sill, a water intake positioned within the hollow portion of the sill, and a water outlet extending out of the fenestration assembly, with the water inlet and the water outlet in fluid communication with the pump.

2. The water management system of claim 1, wherein the water sensor is positioned to sense the presence of water within the water collection space and signal the pump to operate when water is present, the pump drawing water into the water inlet and directed out of the window frame through the water outlet.

3. The system of claim 1, further wherein the power source includes a solar collector mounted outside of the frame of the fenestration assembly and positioned to receive light.

4. The system of claim 1, wherein the fenestration assembly includes a sliding door having a sash slidingly received on the sill.

5. The system of claim 1, wherein the fenestration assembly includes a sliding window unit.

6. The system of claim 1, wherein the fenestration assembly includes a swinging door having a door panel that moves relative to the frame.

7. The system of claim 1, further comprising the water inlet and the water outlet being in fluid communication with each other with the water outlet positioned below the water inlet so that water may flow via gravity from the water collection space through the water outlet when the pump is not operating.

8. The system of claim 1, further comprising the pump being mounted within a side portion of the frame above the hollow portion of the sill.

9. The system of claim 1, further comprising the pump being mounted in a lower portion of the frame below the sash.

10. The system of claim 1, further comprising the water inlet and the water sensor being separate elements.

11. The system of claim 1, further comprising weep holes extending from the hollow portion of the sill to outside the frame of the window assembly.

12. The system of claim 1, further comprising the power source includes a battery mounted within a jamb of the frame.

* * * * *